US010352151B2

(12) United States Patent
Derkacz et al.

(10) Patent No.: US 10,352,151 B2
(45) Date of Patent: Jul. 16, 2019

(54) DOWNHOLE ELECTRONICS CARRIER

(71) Applicant: EVOLUTION ENGINEERING INC., Calgary (CA)

(72) Inventors: Patrick R. Derkacz, Calgary (CA); Aaron W. Logan, Calgary (CA); Justin C. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 88 days.

(21) Appl. No.: 15/305,427

(22) PCT Filed: May 8, 2015

(86) PCT No.: PCT/CA2015/050420

§ 371 (c)(1),
(2) Date: Oct. 20, 2016

(87) PCT Pub. No.: WO2015/168806

PCT Pub. Date: Nov. 12, 2015

(65) Prior Publication Data

US 2017/0044893 A1 Feb. 16, 2017

Related U.S. Application Data

(60) Provisional application No. 61/991,262, filed on May 9, 2014, provisional application No. 61/991,259, filed on May 9, 2014, provisional application No. 62/004,079, filed on May 28, 2014, provisional application No. 62/014,000, filed on Jun. 18, 2014.

(51) Int. Cl.

| | |
|---|---|
| ***E21B 47/01*** | (2012.01) |
| ***E21B 17/00*** | (2006.01) |
| ***E21B 17/02*** | (2006.01) |
| ***E21B 47/12*** | (2012.01) |

(52) U.S. Cl.
CPC ..... *E21B 47/011* (2013.01); *E21B 17/003* (2013.01); *E21B 17/028* (2013.01); *E21B 47/122* (2013.01)

(58) Field of Classification Search
CPC ..... E21B 47/01; E21B 47/011
See application file for complete search history.

(56) References Cited

U.S. PATENT DOCUMENTS

| | | | |
|---|---|---|---|
| 2,112,108 | A | 3/1938 | MacKenzie |
| 2,243,272 | A | 5/1941 | Delbert |
| 2,295,720 | A | 9/1942 | Dietzmann et al. |
| 2,553,985 | A | 5/1951 | Siracusa |
| 3,094,852 | A | 6/1963 | Taylor |

(Continued)

FOREIGN PATENT DOCUMENTS

| | | | |
|---|---|---|---|
| CA | 2502154 | A1 | 10/2005 |
| CA | 2510435 | A1 | 12/2005 |

(Continued)

*Primary Examiner* — D. Andrews
(74) *Attorney, Agent, or Firm* — Oyen Wiggs Green & Mutala LLP

(57) ABSTRACT

A drill string section receives an electronics package. A flow channel extends through an aperture in the electronics package. The flow channel carries a flow of drilling fluid through the drill string section. The flow channel is sealed to a body of the drill string section. The electronics package need not be pressure-rated.

24 Claims, 8 Drawing Sheets

(56) References Cited

U.S. PATENT DOCUMENTS

| | | | | |
|---|---|---|---|---|
| 3,380,324 | A | 4/1968 | Hillman | |
| 3,434,191 | A | 3/1969 | Timmons | |
| 3,463,247 | A | 8/1969 | Klein | |
| 3,768,579 | A | 10/1973 | Klein | |
| 3,915,243 | A | 10/1975 | Hisey et al. | |
| 3,980,143 | A | 9/1976 | Swartz et al. | |
| 4,023,449 | A | 5/1977 | Boyadjieff | |
| 4,147,215 | A | 4/1979 | Hodge et al. | |
| 4,194,579 | A | 3/1980 | Bailey et al. | |
| 4,240,652 | A | 12/1980 | Wong et al. | |
| 4,335,602 | A * | 6/1982 | Walkow | G01V 11/002 73/152.02 |
| 4,445,265 | A | 5/1984 | Olson et al. | |
| 4,496,174 | A | 1/1985 | McDonald et al. | |
| 4,520,468 | A | 5/1985 | Scherbatskoy | |
| 4,658,915 | A | 4/1987 | Goris et al. | |
| 4,693,317 | A * | 9/1987 | Edwards | E21B 17/07 166/378 |
| 4,844,171 | A | 7/1989 | Russell, Jr. | |
| 5,267,621 | A | 12/1993 | Deken et al. | |
| 5,544,712 | A | 8/1996 | McEwen et al. | |
| 5,740,860 | A | 4/1998 | Crawford et al. | |
| 5,817,937 | A | 10/1998 | Beshoory et al. | |
| 5,996,712 | A | 12/1999 | Boyd | |
| 6,098,727 | A * | 8/2000 | Ringgenberg | E21B 17/028 166/242.6 |
| 6,305,723 | B1 | 10/2001 | Schutz et al. | |
| 6,488,323 | B1 | 12/2002 | Bouligny | |
| 6,499,541 | B1 | 12/2002 | Hiron et al. | |
| 6,845,826 | B1 | 1/2005 | Feld et al. | |
| 7,252,160 | B2 | 8/2007 | Dopf et al. | |
| 7,255,183 | B2 | 8/2007 | Cramer | |
| 7,387,167 | B2 | 6/2008 | Fraser et al. | |
| 7,390,032 | B2 | 6/2008 | Hughes | |
| 7,543,650 | B2 | 6/2009 | Richardson | |
| 8,258,976 | B2 | 9/2012 | Price et al. | |
| 8,308,199 | B2 | 11/2012 | Camwell et al. | |
| 8,376,065 | B2 | 2/2013 | Teodorescu et al. | |
| 8,400,160 | B2 | 3/2013 | Fredette et al. | |
| 8,407,006 | B2 | 3/2013 | Gleitman | |
| 8,648,733 | B2 | 2/2014 | Dopf et al. | |
| 8,695,727 | B2 | 4/2014 | Chau et al. | |
| 8,704,677 | B2 | 4/2014 | Prammer | |
| 2004/0226753 | A1 | 11/2004 | Villareal | |
| 2005/0167157 | A1 | 8/2005 | Boyadjieff | |
| 2006/0089804 | A1 | 4/2006 | Chen et al. | |
| 2006/0201717 | A1 | 9/2006 | Cramer | |
| 2006/0225891 | A1 | 10/2006 | Adams et al. | |
| 2007/0063513 | A1 | 3/2007 | Boyd | |
| 2008/0191900 | A1 | 8/2008 | Camwell et al. | |
| 2010/0032210 | A1 | 2/2010 | Teodorescu et al. | |
| 2010/0263495 | A1 | 10/2010 | Webb | |
| 2011/0120269 | A1 | 5/2011 | McCormick et al. | |
| 2011/0180273 | A1 | 7/2011 | Hughes et al. | |
| 2011/0254695 | A1 | 10/2011 | Camwell et al. | |
| 2012/0067649 | A1 | 3/2012 | Wilson | |
| 2012/0085583 | A1 | 4/2012 | Logan et al. | |
| 2012/0137833 | A1 | 6/2012 | Pettit | |
| 2013/0032412 | A1 | 2/2013 | Haugvaldstad et al. | |
| 2013/0120154 | A1 | 5/2013 | Gleitman | |
| 2014/0083773 | A1 | 3/2014 | Minosyan et al. | |
| 2014/0131051 | A1 | 5/2014 | Pratt et al. | |
| 2014/0131994 | A1 | 5/2014 | Holmen et al. | |
| 2014/0150544 | A1 | 6/2014 | Logan et al. | |
| 2015/0114634 | A1 | 4/2015 | Limbacher | |
| 2017/0044853 | A1 | 2/2017 | Derkacz et al. | |
| 2017/0101829 | A1 | 4/2017 | Heide et al. | |

FOREIGN PATENT DOCUMENTS

| | | | |
|---|---|---|---|
| CA | 2570344 | A1 | 12/2005 |
| CA | 2586317 | A1 | 10/2007 |
| CA | 2699023 | A1 | 10/2010 |
| CA | 2796683 | A1 | 5/2013 |
| GB | 2404401 | A | 2/2005 |
| GB | 2470286 | A | 11/2010 |
| WO | 0109478 | A1 | 2/2001 |
| WO | 2010121345 | A1 | 10/2010 |
| WO | 2011049573 | A1 | 4/2011 |
| WO | 20130307058 | A1 | 3/2013 |
| WO | 2014031663 | A1 | 2/2014 |
| WO | 2014066972 | A1 | 5/2014 |
| WO | 2014075190 | A1 | 5/2014 |

* cited by examiner

DOWNHOLE ELECTRONICS CARRIER

TECHNICAL FIELD

This application relates to subsurface drilling, specifically, to downhole tools for use in drilling, and physical structures for containing and protecting electronics in the downhole environment. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically suspended in a bore of a drill string near the drill bit. Some downhole probes are highly specialized and expensive.

Downhole conditions can be harsh. A probe may experience high temperatures; vibrations (including axial, lateral, and torsional vibrations); shocks; immersion in drilling fluids; high pressures (20,000 p.s.i. or more in some cases); turbulence and pulsations in the flow of drilling fluid past the probe; fluid initiated harmonics; and torsional acceleration events from slip which can lead to side-to-side and/or torsional movement of the probe. These conditions can shorten the lifespan of downhole probes and can increase the probability that a downhole probe will fail in use. Replacing a downhole probe that fails while drilling can involve very great expense.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Advantages of EM telemetry, relative to MP telemetry, include generally faster baud rates, increased reliability due to no moving downhole parts, high resistance to lost circulating material (LCM) use, and suitability for air/underbalanced drilling. An EM system can transmit data without a continuous fluid column; hence it is useful when there is no drilling fluid flowing. This is advantageous when a drill crew is adding a new section of drill pipe as the EM signal can transmit information (e.g. directional information) while the drill crew is adding the new pipe. Disadvantages of EM telemetry include lower depth capability, incompatibility with some formations (for example, high salt formations and formations of high resistivity contrast), and some market resistance due to acceptance of older established methods. Also, as the EM transmission is strongly attenuated over long distances through the earth formations, it requires a relatively large amount of power so that the signals are detected at surface. The electrical power available to generate EM signals may be provided by batteries or another power source that has limited capacity.

A typical arrangement for electromagnetic telemetry uses parts of the drill string as an antenna. The drill string may be divided into two conductive sections by including an insulating joint or connector (a "gap sub") in the drill string. The gap sub is typically placed at the top of a bottom hole assembly such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. (Higher frequency signals attenuate faster than low frequency signals.) The electromagnetic signals may be detected at the surface, for example by measuring electrical potential differences between the drill string or a metal casing that extends into the ground and one or more ground rods.

There remains a need for practical, convenient, and reliable apparatus for providing downhole electronic systems.

Further aspects of the invention and features of example embodiments are illustrated in the accompanying drawings and/or described in the following description.

SUMMARY

The following embodiments and aspects thereof are described and illustrated in conjunction with systems, tools, and methods which are meant to be exemplary and illustrate, not limiting in scope. In various embodiments, one or more of the above-described problems have been reduced or eliminated, while some embodiments are directed to other improvements.

One aspect of the invention provides a downhole electronics system including a housing defining a cavity and having a box end and a pin end for removable coupling to the drill string, a drilling fluid flow tube extending through the cavity, and an electronics package removably fitted into the cavity. The electronics package defines an aperture located such that the drilling fluid flow tube passes through the aperture. The electronics package includes a support structure positioned between the aperture and an inner wall of the housing and an electronic component supported by the support structure.

In some embodiments, the electronic component is resiliently supported by the support structure within the cavity.

In some embodiments, the electronics package includes a plurality of electronic modules each supported by the support structure.

In some embodiments, the system includes an interconnection plate in the cavity. Each of the electronics modules is coupled to a corresponding connector on the interconnection plate and the system includes electrical interconnections among the plurality of electronic modules.

In some embodiments, the electronics package includes a mounting plate and each of the electronics modules is attached to the mounting plate such that the mounting plate and electronics modules are removable from the cavity as a unit.

In some embodiments, the electronic modules each include a housing connected to the mounting plate and a connector mounted on an end of the housing remote from the housing plate.

In some embodiments, the mounting plate is annular and the flow tube extends through a central opening in the mounting plate.

In some embodiments, different ones of the electronic modules contain different electronic circuitry providing different functionality from other ones of the plurality of modules.

In some embodiments, the electronic modules include circular cross-sections.

In some embodiments, the electronic modules include faceted outer surfaces.

In some embodiments, the electronic modules include polygonal cross-sections.

In some embodiments, the carrier is cylindrical.

In some embodiments, the electronics package is keyed into the cavity to fix its rotational orientation relative to the rest of the drill string.

In some embodiments, the box end is configured to receive a plug to engage the electronics package for reduction of vibration of the electronics package within the cavity.

In some embodiments, the outside of the drilling fluid flow tube is sealed to prevent ingress of the drilling fluid into the cavity.

In some embodiments, the cavity is sealed against pressure.

In some embodiments, the support structure is U-shaped, C-shaped, arc-shaped, or circular in cross section.

In some embodiments, the electronics package includes at least one of an EM telemetry transmitter and an EM telemetry receiver.

In some embodiments, the drilling fluid flow tube is in fluid communication with a gap section flow tube in a gap section of the drill string including a gap that provides electrical isolation between parts of the drill string uphole and downhole from the gap. The gap flow tube is sealed to portions of the drill string on either side of the gap.

In some embodiments, the gap section flow tube is electrically insulating.

In some embodiments, the system includes a layer of electrically insulating material between the gap section flow tube and the drill string.

In some embodiments, the gap section flow tube is made of a ceramic or plastic material.

In some embodiments, the aperture is coaxial with an outer surface of the housing.

In some embodiments, the system includes one or more locating pins arranged to align the electronics package to have a predetermined rotational alignment within the cavity.

In some embodiments, the carrier is not more than 60 cm in length.

In some embodiments, a wall of the housing adjacent the cavity is sufficiently thin that a pressure differential across the wall of 6000 psi (about 42 MPa) or less is sufficient to distort the wall in the absence of the electronics package wherein the electronics package is constructed to provide mechanical support to the wall when the electronics package is received in the chamber.

Another aspect of the invention provides a kit including a downhole electronics system according to any embodiment described herein and a plurality of different electronic modules for insertion into the support structure.

In addition to the exemplary aspects and embodiments described above, further aspects and embodiments will become apparent by reference to the drawings and by study of the following detailed description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
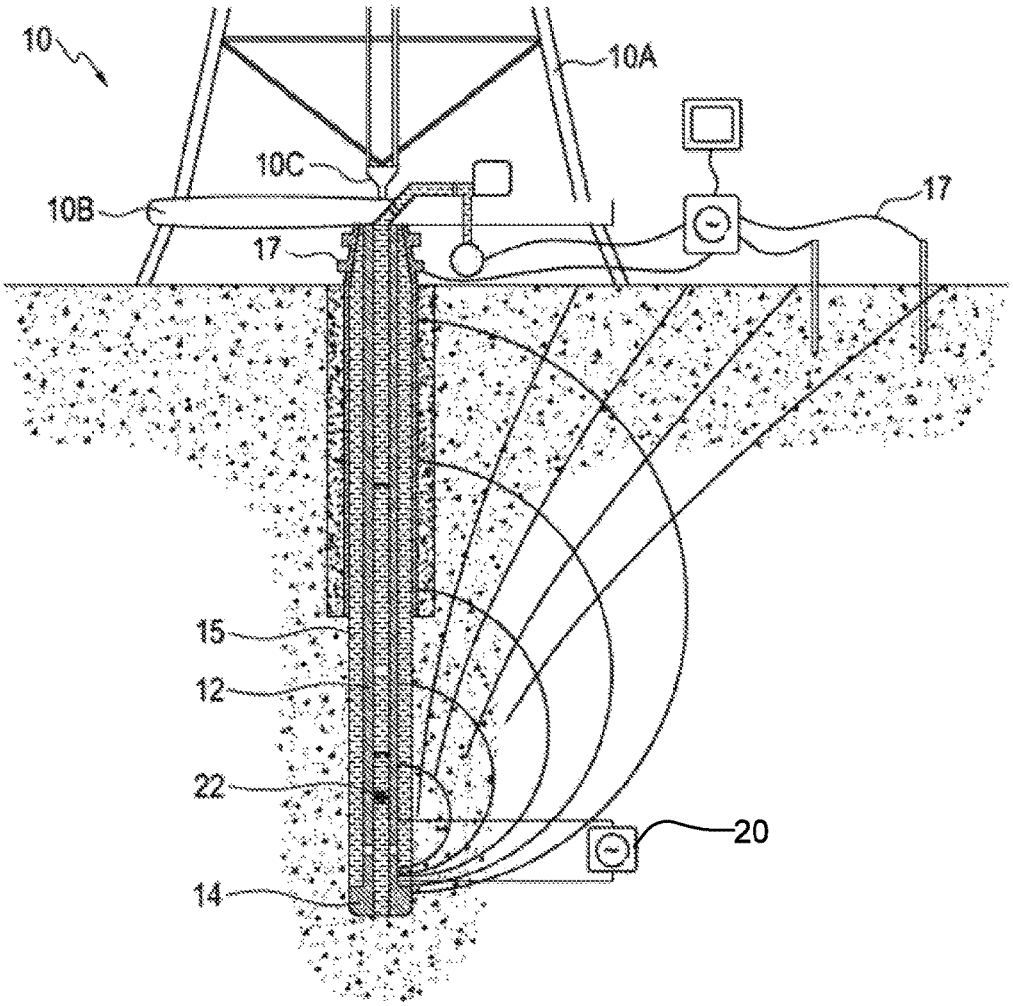
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

One aspect of the invention provides a downhole electronics package which has a central aperture passing through it, such that a flow of drilling fluid can be directed through a central pressure-rated channel (which may pass through the aperture). The electronics package may have a toroidal configuration. Electronics may be located around the channel. The channel may be defined in a flow sleeve which carries drilling fluid through the central aperture in the electronics package. The flow sleeve may be made of a material having high resistance to erosion and/or wear. Suitable materials for the flow channel may include erosion-resistant metals, ceramics and carbides.

Figure 2:
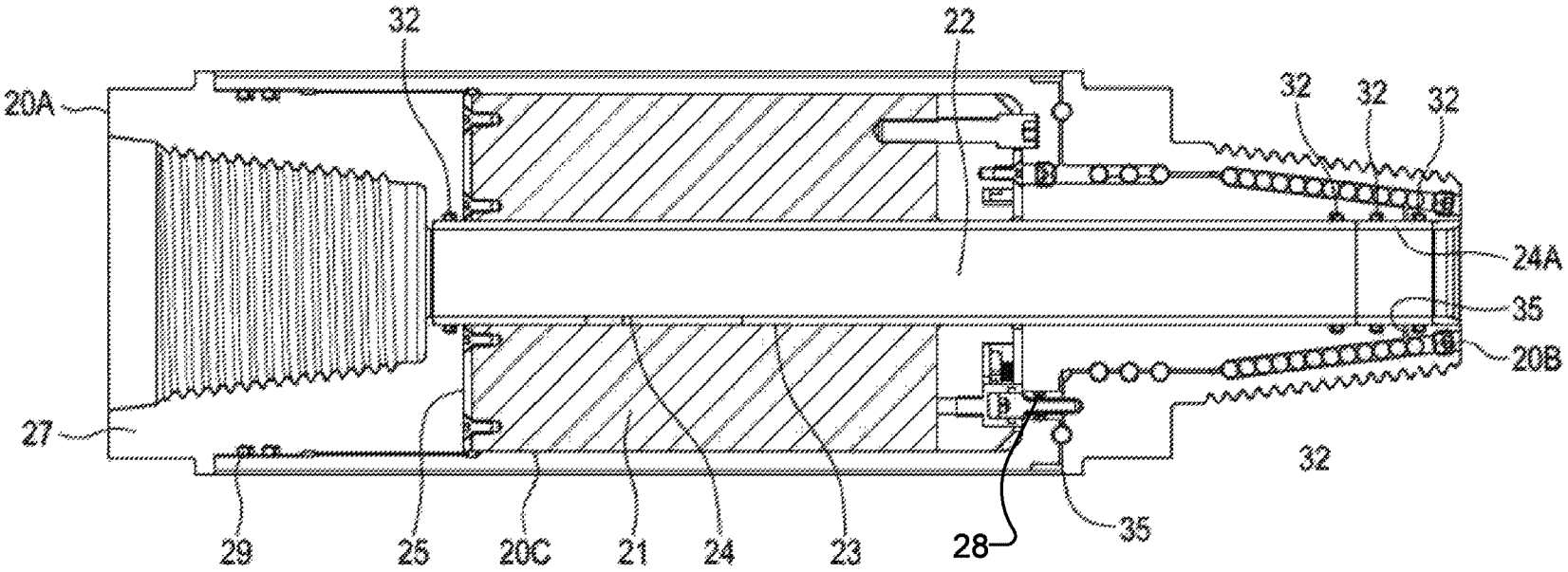
FIG. 2 is a cross-section through a drill string section comprising a flow channel passing through an aperture in an electronics package.
Figure 3:
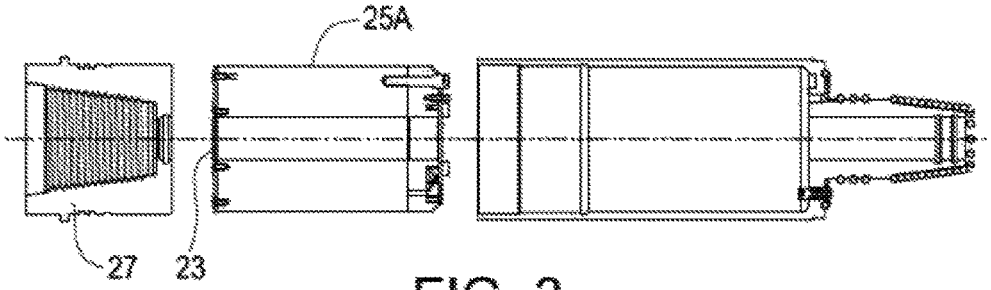
FIG. 3 is an exploded view showing an electronics package and plug oriented to be introduced into a drill string section.
Figure 4:
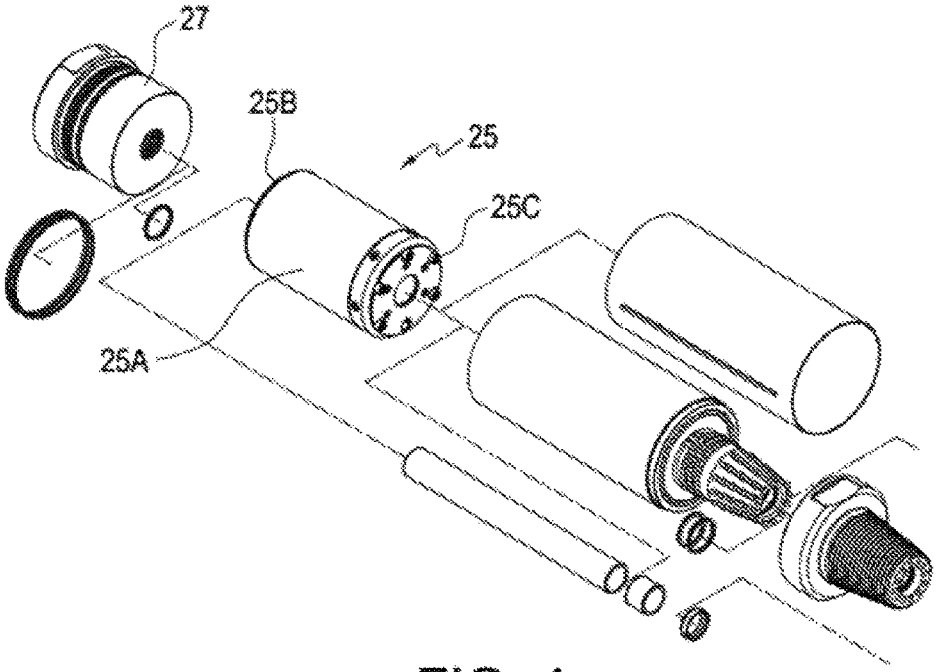
FIG. 4 is an exploded view showing parts of a drill string section including a flow tube and example gap assembly.

FIG. 2 shows a simple example embodiment. A drill string section 20 has a central bore 22. Central bore 22 extends from a box end 20A of the drill string section through the drill string section to a pin end 20B of the drill string section. A flow tube 24 extends through the drill string section. The flow tube lines all or some of bore 22. Drill string section 20 is configured such that there is a gap between flow tube 24 and an inner wall of the drill string section. The gap forms an annular chamber 21 surrounding the flow tube. An electronics package 25 is received in chamber 21. Flow tube 24 passes through an aperture 23 in electronics package 25.

In an example embodiment, one end of drill string section 20, in the illustrated embodiment box end 20A, is removably coupled to the rest of drill string section 20. Removing that end of the drill string section provides access to electronics package 25.

In the illustrated embodiment, a box end 20A of drill string section 20 is provided on a plug 27 which can be removably inserted into a bored out portion 20C of drill string section 20. Threads 26A on plug 27 engage with threads 26B on the interior of the drill string section so that the plug can be screwed into place at the end of drill string section 20.

An electronics package 25 may first be received in bore 20C and then held in place by the plug after the plug has been screwed into place. An axial dimension of electronics package 25 may be selected so that electronics package 25 is held snugly and/or compressed between plug 27 and a surface 20D on an opposing end of bored-out cavity 20C when plug 27 is fully engaged.

O-rings or other seals 29 may be provided to prevent ingress of drilling fluid past plug 27.

Flow tube 24 is sealed in place by O-rings or other seals 32 in plug 27 as well as in the other end (e.g. pin end 20B) of drill string section 20. Seals 29 and 32 prevent drilling fluid from entering chamber 21 in which electronics package 25 is located.

The threads on the outside of plug 27 may, for example, comprise an acme thread. In the illustrated embodiment, the inner face of plug 27 which bears against one end of the electronics package has a large surface area. This permits high friction to be developed between plug 27 and electronics package 25 to prevent rotation of plug 27 after it has been installed. Compression of electronics package 25 between plug 27 and the other end 20A of bore 20C in which it is located ensures repeatable axial placement of the electronics package and avoids or reduces vibration of the electronics package within its cavity.

In some embodiments, the electronics package is keyed into the chamber in which it is received so that its rotational orientation remains fixed relative to drill string section 20. The keying may, for example, be provided by one or more pins, keyways, keys, or other engagement features which provide one or more of holding electronics package 25 in a fixed or angular orientation after it has been installed and making it be the case that electronics package 25 can be inserted only in one rotational orientation.

One advantage of this construction is that the portion of drill string section 20 which houses electronics package 25 may be sealed against pressure such that electronics package 25 itself does not itself need to be constructed in a manner that is pressure rated.

In some alternative embodiments, the chamber in which electronics package is received has one or more flat sides or is otherwise non-round and electronics package 25 has a shape that non-rotationally engages in the chamber.

In the illustrated embodiment, drill string section 20 comprises a gap section for use in EM telemetry. In this embodiment, the portions of drill string section 20 to which flow tube 24 is sealed are on either side of the gap and are electrically insulated from one another. In such embodiments, flow tube 24 should not create an electrical short circuit across the gap. This can be achieved by one or more of:

- making flow tube 24 of an electrically insulating material;
- making a section of flow tube 24 of an electrically insulating material;

providing a layer of electrically insulating material between flow tube 24 and at least one of the parts of drill string section 20 to which it is sealed.

In the depicted embodiment, flow tube 24 includes an electrically insulating portion 24A. Electrically insulating portion 24A prevents flow tube 24 from shorting out the gap 35 provided by the gap section. The electrically-insulating portion of the flow tube may, for example, comprise a suitable plastic (e.g. 30% glass-filled PEEK), ceramic, and/or a suitable composite material.

In some embodiments the walls of drill string section 20 are made to be relatively thin at least in their parts surrounding bored-out portion 20C. The walls may be made thin enough that the pressure acting on the outside of the drill string section when downhole would distort or move the walls inwardly in the absence of support from inside. In such embodiments, electronics package 25 may provide support on the inside of the walls to prevent the walls from collapsing under the pressure experienced downhole. Downhole pressures are can equal or exceed 3000 pounds per square inch (about 21 MPa) in some wells.

For example, electronics package 25 may include a housing or carrier 25A which may be made of a stiff material such as a suitable extruded material (e.g. plastic or metal). Carrier 25A may comprise a body that fits closely against the wall of section 20 when electronics package 25 is received in bored-out section 20C. In some embodiments, the body comprises an extruded form.). The electronics carrier may be a running fit into the bore 20C into which it is situated.

Providing a thin wall in section 20C increases the volume available internally for housing electronics. The material of the portion of electronics package 25 that contacts plug 27 may be a non-galling material and/or a material that is distinct from the material of plug 27 to reduce or avoid the possibility of galling between the plug and the electronics package. For example, plate 25 may be made of beryllium copper alloy.

Figure 5:
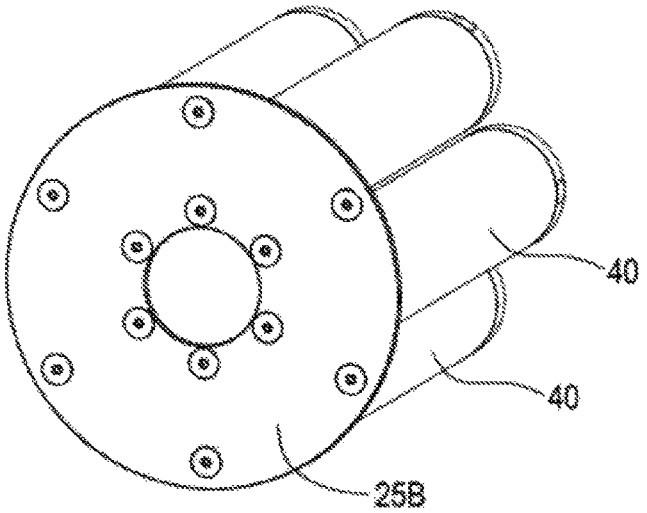
FIG. 5 is a perspective view of an assembly comprising a mounting plate carrying a plurality of electronics modules.
Figure 6:
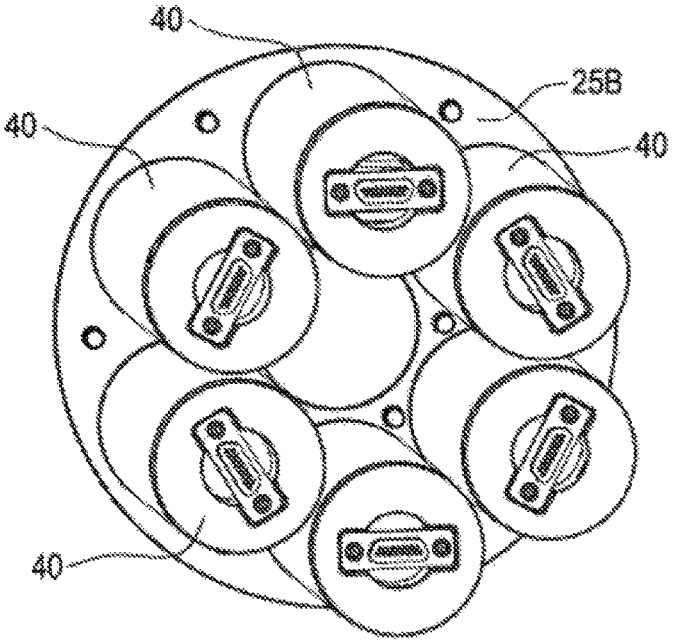
FIG. 6 is a perspective view of the assembly of FIG. 5 viewed from an end on which electrical connectors are provided.
Figure 6A:
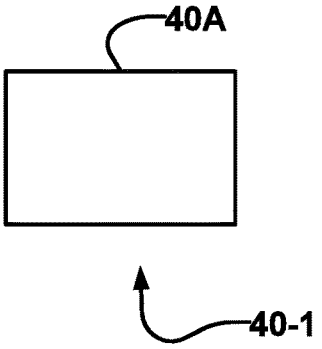
FIGS. 6A, 6B, 6C and 6D are schematic cross-sectional views of example electronic modules having various cross-sectional shapes.
Figure 6B:
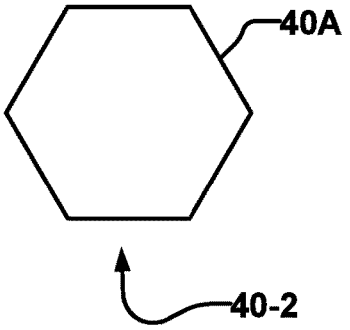
Figure 6C:
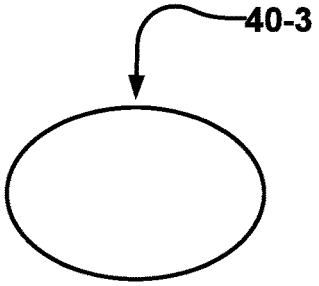
Figure 6D:
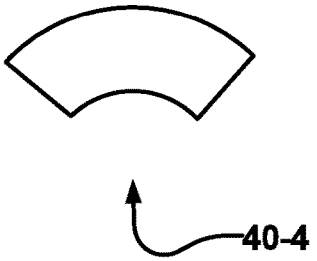

In some embodiments, the electronics carrier comprises a support structure configured to support a number of separate electronics modules 40. FIGS. 5 and 6 show examples of such a carrier. The support structure may hold the electronics modules in place and may provide a mechanism for electrical interconnection of the electronics modules. In the illustrated embodiment, the support structure comprises a plate 25B, electronics carrier 25A, and an interconnection member 25C. Attachment of electronics modules 40 to plate 25B holds the electronic modules 40 in desired relative positions and orientations and facilitates retrieving the electronics modules 40 as a unit. Plate 25B holds each electronics module 40 in a desired orientation. Interconnection member 25C provides electrical interconnections among the modules for power and/or data. In the illustrated embodiment, electronics modules 40 are circular in cross-section. This is convenient but not mandatory. Modules 40 could have other cross-sectional shapes such as rectangular (see module 40-1 in FIG. 6A), oval (see module 40-3 in FIG. 6C), hexagonal (see module 40-2 in FIG. 6B), shape like a sector of an annulus (see module 40-4 in FIG. 6D), etc. Example modules 40-1 and 40-2 comprising faceted outer surfaces 40A are shown in FIGS. 6A and 6B.

In some embodiments, electronics package 25 includes electrical contacts for connecting to external components. For example, the electrical contacts may include first and second contacts connected to outputs of an EM telemetry signal generator in the electronics package. In some embodiments, one contact is located to engage plug 27 and a second contact is located to engage an electrical conductor on an opposing end of electronics package 25. The second contact may, for example, make electrical connection with an electrical conductor that passes across the gap to contact pin end 20B. In the embodiment illustrated in FIG. 2, this contact may be provided by means of a bolt or other electrical conductor 28 that extends from chamber 21 through an electrically insulating sleeve to provide electrical connectivity to pin end 20B on the side of the gap away from chamber 21.

In some alternative embodiments, electronics package 25 is U-shaped or C-shaped to allow flow tube 24 to pass by it. In other embodiments, electronics package 25 is made up of a number of separable segments that can be packed in around flow tube 24. The segments may be arc-shaped in cross section, for example.

FIGS. 5 and 6 show an assembly comprising a plate 25B attached to a plurality of electronics modules 40.

Different electronics modules 40 may be provided. For example, some modules may include different sorts of downhole sensors. Other modules may include batteries. Other modules may include control systems. Other modules may include telemetry systems. Other modules may include combinations of these. Different modules 40 may be fitted into different bays 42 in carrier 25A, as desired.

In the illustrated embodiment, electronics bays 42 and electronics modules 40 are both circular in cross section. A round cross section is advantageous for cost-effective manufacturing but is not mandatory.

In some embodiments, each electronics module 40 has an electrical connector 41A and interconnection member 25C comprises an interconnection plate 44 and interconnected electronics connectors 41B which correspond with and are configured to mate with connectors 41A. Each of the electronics connectors 41A, 41B may comprise multiple pins. For example, MDM connectors may be used. This construction permits assembly of an electronics package by inserting appropriate electronics modules 40 into available bays 42 until the connector on each module 40 engages a corresponding connector on interconnection plate 44. This can provide for relatively foolproof assembly and an overall more rugged electronics package 25. Bays 42 may be designed to permit only unidirectional loading of modules and to preserve a desired orientation of each electronics module 40 relative to electronics carrier 25.

Figure 7:
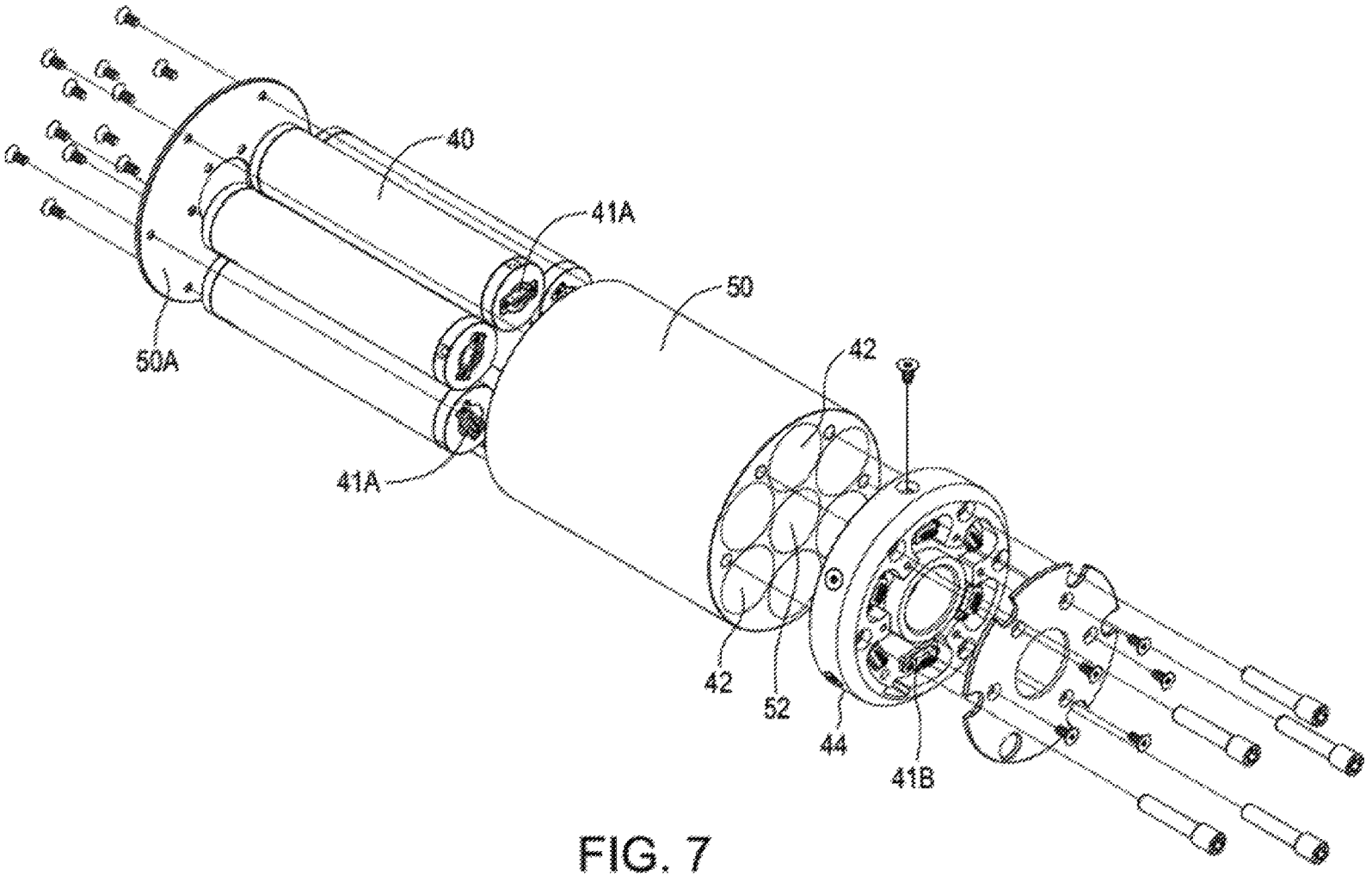
FIG. 7 is an exploded view of an apparatus according to the example embodiment.

FIG. 7 shows an electronics carrier comprising a body 50 having a central aperture 52 for carrying a flow of drilling fluid through a flow channel (not shown in this Figure). Surrounding the central bore are a plurality of bores 54 which each provide a bay 42 for receiving a corresponding electronics module 40. Each electronics module 40 has an electrical connector 41A on one end thereof. Modules 40 may be inserted into corresponding bays 42 until electronics connectors 41A engage with corresponding connectors 41B in interconnection plate 44.

A mounting plate 25B mounts to the opposing end of the electronics carrier. In some embodiments, all of the electronics modules are mounted to plate 25B and then slid together into body 50 until the electrical connectors on the electronics modules mate with the electronics connectors on interconnection plate 44. The entire electronics package may then be inserted into cavity 20C of drill string section 20. A flow tube may be installed before or after installing the electronics package.

Figure 6E:
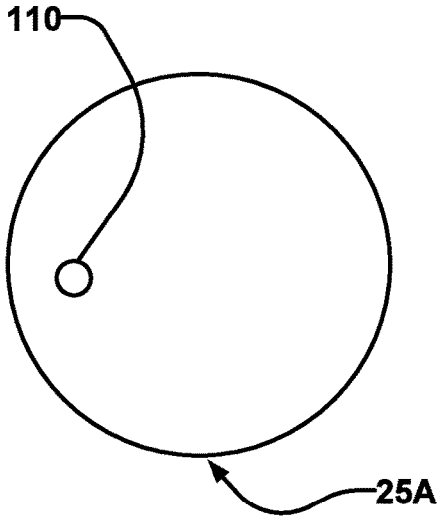
FIG. 6E is a schematic view showing an electronics carrier having a pin.
Figure 8:
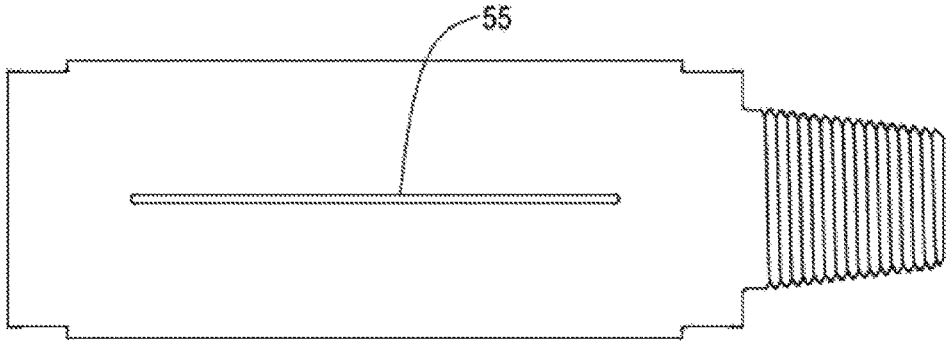
FIG. 8 is a view of a sub including a high side marking.

One or more locating pins 110 may be provided on electronics carrier 25A (see FIG. 6E) so that it may be fully inserted in only one orientation into the drill string section. In some embodiments, locating pins 110 are located relative to a high side of the drill string section 20. For example, a marking 55 (see FIG. 8) may be provided on an outside surface of the drill string section 20 which can be aligned with the high side of a bend on a bent sub or mud motor after the drill string section has been integrated into the drill string. The marking may be in a location that can be fixed relative to locating pins 110.

One advantage of an electronics carrier in which drilling fluid flows on-axis through the electronics carrier is that such an electronics carrier is affected less by debris and/or LCM in the drilling fluid than are electronics carriers of the type which sit within the flow of drilling fluid. Electronics carriers of the type described herein may be placed anywhere along a drill string. For example, such electronics carriers may be placed: above a BHA, within a BHA, between a motor and a drill bit.

In some embodiments, an electronics carrier as described herein is provided in a sub that is equipped with a mechanism configured to permit the electronics carrier to be rotated relative to couplings on one or both ends of the sub. This functionality may, for example, be applied to align axes of certain sensors in the electronics package with the high side of a bent section in the drill string.

Figure 9:
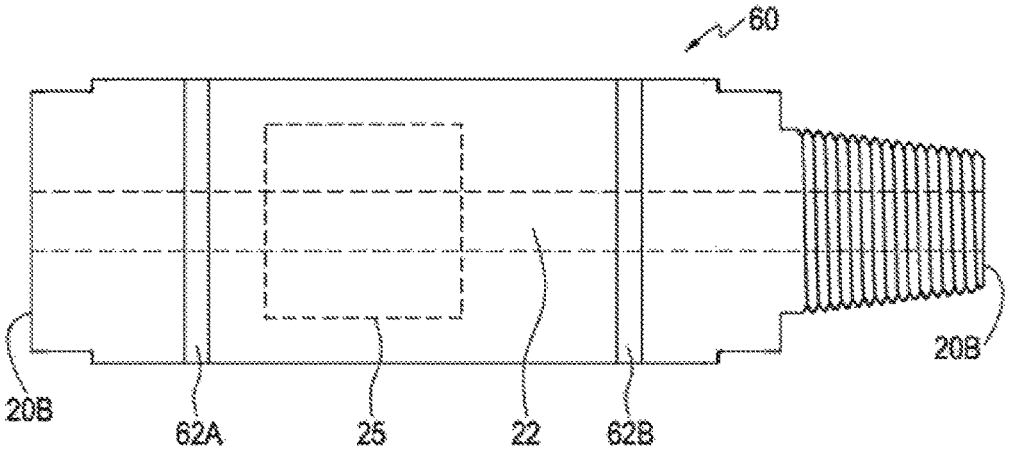
FIG. 9 is a schematic view of a sub having a mechanism for rotating an electronics package relative to a coupling.

FIG. 9 shows an example sub 60 which contains an electronics package 25. A through bore 22 extends between couplings on opposed ends 20A, 20B of sub 60. Sub 60 has locking swivel mechanisms 62A and 62B which respectively permit rotation of ends 20A and 20B of sub 60 relative to electronics package 25. Some embodiments of sub 60 have only one of mechanisms 62A and 62B.

Mechanisms 62A and 62B may, for example, comprise swivel joints that may be locked at desired angles of rotation using pins, bolts, locking collars, a toothed collar that can be slid axially to engage teeth on an opposing side of the mechanism, or the like. One possible mechanism 62A and/or 62B is disclosed in PCT patent publication No. WO 2014/094161.

In other embodiments, an electronics carrier as described herein is provided in a compartment of a bent section of a drill string and so can have a fixed orientation relative to a high side of the bent section. For example, sub 60 may be provided in such a drill string. Such a sub (e.g. sub 60) may be compact in length, being not more than two feet (approximately 60 cm) in length, not including the length of a projecting pin coupling, if present.

Figure 10:
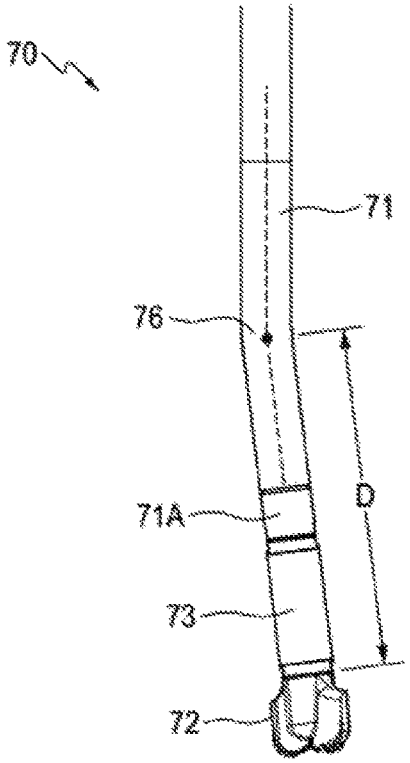
FIG. 10 is a cross-sectional view of a bottom part of a drill string according to an example embodiment.

FIG. 10 is an enlarged view of a bottom part of a bent drill string 70 according to an example embodiment. Drill string 70 includes a mud motor 71 which has a rotating output mandrel 71A coupled to drive a drill bit 72. A sub 73 is coupled into the drill string between mandrel 71A and drill bit 72. In the illustrated embodiment, sub 73 is coupled directly to mandrel 71A at its uphole end and is coupled directly to drill bit 72 at its downhole end.

Drill string 70 also includes a bend 76 spaced apart by a distance D from drill bit 72. The direction of drilling by drill string 70 may be altered by rotating drill string 70. Because drill string 70 has a bend 76, this rotation alters the angle at which drill bit 72 addresses a formation into which it is drilling.

By making sub 73 very short as described above, adding sub 73 into the drill string increases the distance between bend 76 and drill bit 72 by at most two feet (about 60 cm) as compared to the case where the drill bit 72 is coupled directly to mandrel 71A of mud motor 71. Since increasing D tends to reduce the ease of steering of drill bit 70 and also increases the minimum radius of turns through which it is possible to turn the direction of the bore drilled by drill string 70, maintaining distance D to be small by using a short sub 73 facilitates improved steering of the drill string. Furthermore, maintaining distance D to be small facilitates faster and more efficient drilling of straight sections of borehole.

A drill string with a bend may be used to drill a straight section of borehole by continuously rotating the drill string while the drill bit turns. Where distance D is relatively large, the diameter of the straight section of borehole will be relatively large and therefore drilling will be relatively slow and inefficient. Keeping distance D relatively small can also beneficially reduce drag of the drill string against the wall of the borehole. These advantages may be combined with reduced wear on drill bit 72. Furthermore, maintaining a short bend-to-bit distance D allows the use of drill strings in which bend 76 has a reasonably large angle (for example, up to 4°). In some embodiments the bend is in the range of 7° to 4° although smaller bend angles may be provided. If the bend-to-bit distance D were significantly increased, then it would be necessary to reduce the angle of bend 76. This, in turn, would require the use of specialized drilling equipment (e.g. fixed-bend motors) which are less common. Providing a short sub 73 (where "short" with reference to a sub in this disclosure means that introducing the sub into the drill string adds no more than 2 feet (about 60 cm) to the length of the drill string) facilitates the above. Sometimes mud motors with fixed-bit-to-bend housings (rather than the more common adjustable-bend housings) are used to reduce the bit-to-bend distance D. Fixed-bit-to-bend housings may be used with the short sub described herein to further reduce distance D while providing the MWD capabilities of sub 70.

In some embodiments, sub 73 may comprise a short drill string section 20, substantially as described above with reference to FIG. 2. One feature which facilitates making drill string section 20 short is that the electronics may be packaged around bore 22. In the illustrated embodiment, an electronics package 25 is annular in cross section. Furthermore, in the region of drill string section 20 where the electronics are packaged, the wall of drill string section 20 is made thin, thereby increasing the available volume for housing the electronics package. The electronics package is constructed so as to provide mechanical support to the wall of drill string section 20, thereby creating a structure in which the wall of drill string section 20 can withstand the forces exerted on it by the pressures downhole. In the illustrated embodiment, electronics package 25 has an outer surface that is circular in cross section and is in full contact with the wall of section 20C which surrounds electronics package 25. In some embodiments, drill string section 20 has a diameter slightly larger than the diameter of mandrel 71A.

Another feature that facilitates making drill string section 20 short is that drill string section 20 may not include any significant allowance for re-cutting couplings on opposed ends 20A, 20B. In some embodiments, one or both of such couplings is made replaceable such that, if the coupling is damaged in use, it can be replaced (as opposed to using a sub with extra length so that the couplings can be re-machined (with a resulting loss of length of the sub) without impacting the functionality of the sub. By making such couplings replaceable, length that might otherwise be provided for future re-cutting of the couplings can be eliminated.

Another feature that assists in making drill string section 20 short is the arrangement provided for communicating data by EM telemetry. Data may be transmitted by or received by drill string section 20 through use of an electrically-insulating gap which electrically insulates the portion of drill string section 20 connected to the drill bit or other downhole component of the drill string from the mud motor or other uphole component of the drill string to which drill string section 20 is coupled. In the illustrated embodiment, a gap 35 is provided which extends into the pin end of drill string section 20 and is therefore very compact.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation of Terms

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back", "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A downhole electronics system comprising:

a housing defining a cavity and having a box end and a pin end for removable coupling to a drill string, the housing including a gap that provides electrical isolation between the box end and the pin end of the housing;

a drilling fluid flow tube extending through the cavity;

a gap section flow tube extending across the gap;

an electrical conductor extending from the cavity through an electrically insulating sleeve, the electrical conductor spanning the gap; and an electronics package removably fitted into the cavity, the electronics package defining an aperture located such that the drilling fluid flow tube passes through the aperture and comprising:

a support structure; and an electronic component supported by the support structure;

wherein:

the cavity is sealed against pressure, the drilling fluid flow tube is in fluid communication with the gap section flow tube, the gap flow tube is sealed to portions of the drill string on either side of the gap, and the electronic component is electrically connected across the gap by way of the electrical conductor.

2. A downhole electronics system according to claim 1 wherein the electronics package comprises a plurality of electronic modules each supported by the support structure.

3. A downhole electronics system according to claim 2 comprising an interconnection plate in the cavity, each of the electronics modules is coupled to a corresponding first connector on the interconnection plate and the system comprises electrical interconnections among the plurality of electronic modules.

4. A downhole electronics system according to claim 3 wherein the electronics package comprises a mounting plate and each of the electronics modules is attached to the mounting plate such that the mounting plate and electronics modules are removable from the cavity as a unit.

5. A downhole electronics system according to claim 4 wherein the electronic modules each comprise a housing connected to the mounting plate and a second connector mounted on an end of the housing remote from the mounting plate.

6. A downhole electronics system according to claim 4 wherein the mounting plate is annular and the flow tube extends through a central opening in the mounting plate.

7. A downhole electronics system according to claim 2 wherein different ones of the electronic modules contain different electronic circuitry providing different functionality from other ones of the plurality of modules.

8. A downhole electronics system according to claim 2 wherein the electronic modules comprise circular cross-sections.

9. A downhole electronics system according to claim 8 wherein the support structure is cylindrical, the drilling fluid flow tube passes through the support structure along a longitudinal axis of the support structure and the electrical conductor extends parallel to the longitudinal axis of the support structure.

10. A downhole electronics system according to claim 2 wherein the electronic modules comprise faceted outer surfaces.

11. A downhole electronics system according to claim 2 wherein the electronic modules comprise polygonal cross-sections.

12. A downhole electronics system according to claim 1 wherein the electronics package is rotationally fixed relative to the rest of the drill string.

13. A downhole electronics system according to claim 1 wherein the box end is configured to receive a plug to engage the electronics package for reduction of vibration of the electronics package within the cavity.

14. A downhole electronics system according to claim 1 wherein the outside of the drilling fluid flow tube is sealed to prevent ingress of the drilling fluid into the cavity.

15. A downhole electronics system according to claim 1 wherein the support structure is annular in cross section and has a cylindrical outer surface that fits closely against an outer wall of the housing.

16. A downhole electronics system according to claim 1 wherein the electronics package includes at least one of an EM telemetry transmitter and an EM telemetry receiver and the electronic component is part of the EM telemetry transmitter or the EM telemetry receiver.

17. A downhole electronics system according to claim 1 wherein the gap section flow tube is electrically insulating.

18. A downhole electronics system according to claim 17 wherein the gap section flow tube is made of a ceramic or plastic material.

19. A downhole electronics system according to claim 1 comprising a layer of electrically insulating material between the gap section flow tube and the drill string.

20. A downhole electronics system according to claim 1 wherein the aperture is coaxial with an outer surface of the housing.

21. A downhole electronics system according to claim 1 comprising one or more locating pins arranged to align the electronics package to have a predetermined rotational alignment within the cavity.

22. A downhole electronics system according to claim 1 wherein the housing is not more than 60 cm in length.

23. A downhole electronics system according to claim 1 wherein a wall of the housing adjacent the cavity is sufficiently thin that a pressure differential across the wall of 6000 psi or less is sufficient to distort the wall in the absence of the electronics package wherein the electronics package is constructed to provide mechanical support to the wall when the electronics package is received in the chamber.

24. A kit comprising:

a downhole electronics system according to claim 2;

a plurality of different electronic modules for insertion into the support structure.

* * * * *